United States Patent [19]

Wolf

[11] 4,320,737

[45] Mar. 23, 1982

[54] FLUE ARRANGEMENT FOR STOVE AND FIREPLACE

[76] Inventor: Mert L. Wolf, 2144 Lafayette, Waterloo, Iowa 50707

[21] Appl. No.: 80,689

[22] Filed: Oct. 1, 1979

Related U.S. Application Data

[63] Continuation of Ser. No. 857,232, Dec. 5, 1977, abandoned.

[51] Int. Cl.[3] ..... F24C 1/00

[52] U.S. Cl. ..... 126/58

[58] Field of Search ..... 126/58, 4, 28, 314–319

[56] References Cited

U.S. PATENT DOCUMENTS 286,248 10/1883 Allen ..... 126/4

1,866,427 7/1932 Siemer ..... 126/58

FOREIGN PATENT DOCUMENTS 76882 8/1917 Fed. Rep. of Germany ..... 126/58

574232 3/1958 Italy ..... 126/4

*Primary Examiner*—Samuel Scott

*Assistant Examiner*—Wesley S. Ratliff, Jr.

*Attorney, Agent, or Firm*—Henderson & Sturm

[57] ABSTRACT

A coal or wood burning stove or fireplace including a fire chamber, the upper part of which is defined by a cooking surface having a horizontally disposed top portion and an arcuate portion extending forwardly and downwardly from the top portion. A flue is disposed within the fire chamber parallel to the top portion and has an open end terminating at the midpoint of the radius of the arcuate portion. The position of the end of the flue with respect to the arcuate portion permits slow, even and complete burning of the fuel in the fire chamber.

1 Claim, 7 Drawing Figures

FLUE ARRANGEMENT FOR STOVE AND FIREPLACE

CROSS-REFERENCE TO RELATED APPLICATION

This is a continuation of application Ser. No. 857,232, filed on Dec. 5, 1977, now abandoned.

BACKGROUND OF THE INVENTION

The present invention relates generally to coal or wood burning stoves and fireplaces and more particularly to the flue arrangement with respect to an arcuate portion of the cooking surface of the stove or fireplace.

In conventional stoves or fireplaces the open end of the flue is either attached to the wall forming the fire chamber or extends slightly into the fire chamber. With this arrangement, the fuel is not completely burned since great quantities of unburned fuel particles and heat are vented through the flue and up the chimney.

Those concerned with the efficient use of fuels recognize the need for an improved flue arrangement for coal or wood burning stoves and fireplaces.

SUMMARY OF THE INVENTION

The instant invention relating to stoves or fireplaces involves the combination of an arcuate portion of the cooking surface, which defines the upper part of the fire chamber, and a cylindrical flue disposed within the fire chamber and having an open forward end located at the midpoint of the radius of the arcuate portion. The position of the flue relative to the arcuate portion permits the burning particles of fuel to be held in suspension within the fire chamber, thus, allowing for complete combustion and eliminating the loss of fuel particles and heat up the chimney.

An object of the present invention is the provision of an improved stove or fireplace.

Another object is to provide a stove or fireplace that permits complete combustion of the fuel and allows longer, cleaner, even burning resulting in minimum heat and fuel loss.

A further object of the invention is the provision of a stove or fireplace wherein no grates are needed and cleanup is facilitated due to complete combustion of the fuel.

Still another object is to provide a stove or fireplace capable of using fuels other than wood.

A still further object is to provide a stove or fireplace allowing faster starting, uniform heating, and improved control of combustion for more efficient operation.

Other objects, advantages, and novel features of the present invention will become apparent from the following detailed description of the invention when considered in conjunction with the accompanying drawings.

DESCRIPTION OF THE PREFERRED EMBODIMENTS

Figure 1:
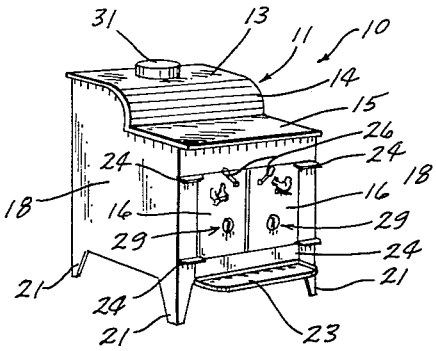
FIG. 1 is a perspective view of a stove showing a cooking surface including an arcuate portion extending forwardly and downwardly from a horizontal top portion.
Figure 4:
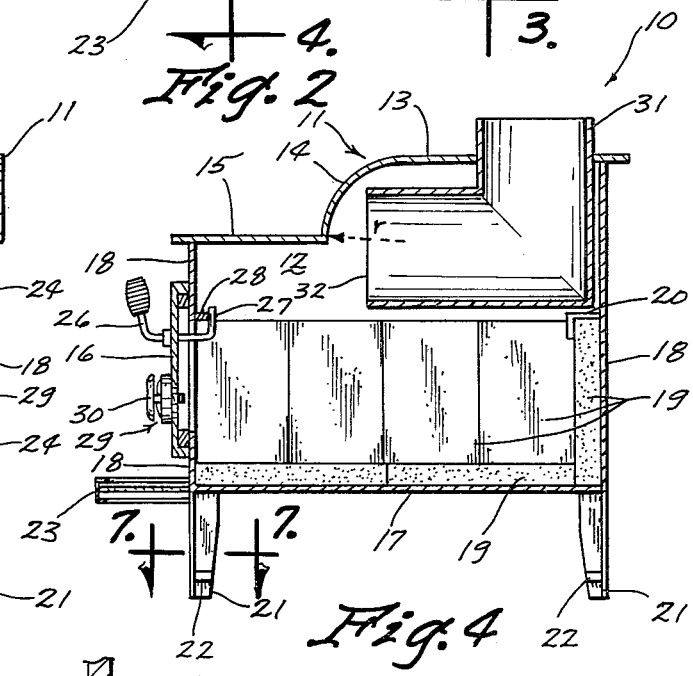
FIG. 4 is a sectional view taken along line 4—4 of FIG. 2 showing the relationship of the end of the flue to the arcuate portion of the cooking surface.
Figure 5:
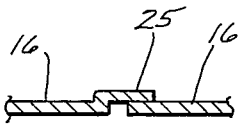
FIG. 5 is a sectional view taken along line 5—5 of FIG. 3 showing the sealing overlap of the doors.
Figure 6:
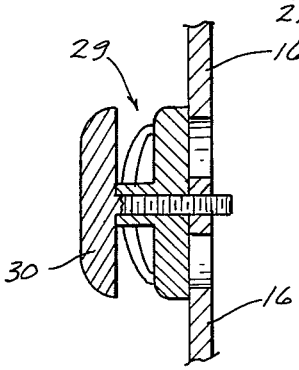
FIG. 6 is a sectional view taken along line 6—6 of FIG. 3 showing the draft cap.

Referring now to the drawings, wherein like reference numerals designate identical or corresponding parts throughout the several views, FIG. 1 shows a stove or fireplace 10 including a cooking surface 11 which defines the upper part of the fire chamber or fire box 12 (FIG. 4). The cooking surface 11 includes a horizontally disposed top portion 13, an arcuate portion 14 extending forwardly and downwardly from the forward end of the top portion 13, and a horizontally disposed lower portion 15 extending forwardly from the lower end of the arcuate portion 14.

Figure 7:
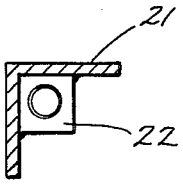
FIG. 7 is a sectional view taken along line 7—7 of FIG. 4 showing the level adjusting nut of the legs.

As shown in FIG. 4, the fire chamber 12 is defined by the doors 16, bottom 17, and sidewalls 18, together with surface 11. The fire chamber 12 is lined with fire brick 19 at the bottom, rear and sides; and the upper ends of the fire brick 19 are held secure to the sidewalls 18 by angle 20. The stove or fireplace 10 is supported by a plurality of legs 21 which include a level adjusting nut 22 (FIG. 7). An ash apron 23 extends forwardly of sidewall 18 below the doors 16.

As shown most clearly in FIGS. 3–6, the doors 16 are hingedly attached to the front sidewall 18 by hinges 24. When in the closed position, the doors 16 overlap at 25 (FIG. 5) and substantially seal the fire chamber 12 from the atmosphere. It is understood that when a single door 16 is used, rather than the double doors 16 shown in the drawings, the free end of the door 16 will seal against sidewall 18. Door handles 26 are rotatably mounted on the doors 16 and include an internally disposed latch 27 adapted to engage the lip 28 (FIG. 4) of front sidewall 18 to hold the doors 16 in the closed position. A two-piece draft cap 29 (FIG. 6) is attached to the doors 16 and a threadably mounted cover 30 is rotated to increase or decrease the flow of air into the fire chamber 12 and regulate the burning of the fuel.

Figure 2:
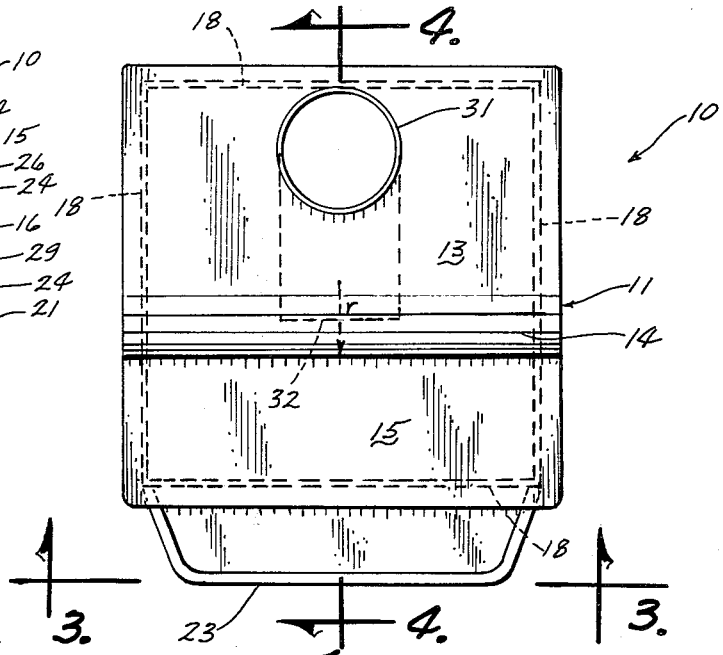
FIG. 2 is a top plan view of the stove showing the sidewalls and flue in dotted lines.
Figure 3:
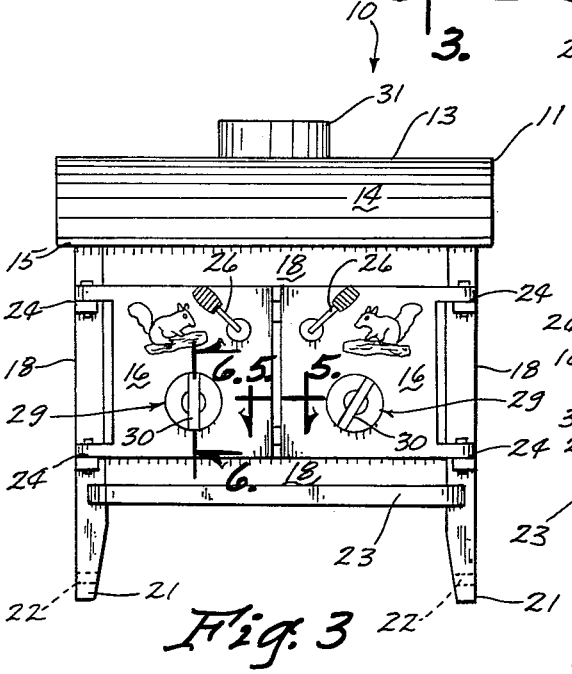
FIG. 3 is a front elevational view of the stove taken along line 3—3 of FIG. 2.

As best shown in FIGS. 2 and 4, the flue 31 extends through an opening in the top portion 13 of the cooking surface 11 and is attached thereto by weldment or the like. It is understood that the flue 31 could likewise extend directly rearward through the rear sidewall 18 if such an arrangement is desired. A portion of the flue 31 extends parallel to the top portion 13 within the fire chamber 12 and the forward open end 32 of the flue 31 terminates at the midpoint of the radius r of the arcuate portion 14. The arcuate portion 14 and the arrangement of the open end 32 of the flue 31 with respect to the arcuate portion 14 is critical to the efficient operation of the stove or fireplace 10.

In operation, a supply of wood or other suitable fuel is placed in the fire chamber 12 and ignited. The doors 16 are then closed and the draft is controlled by adjustment of the draft caps 29. The fire chamber 12, and specifically the arcuate portion 14 and flue end 32, are so designed and arranged to hold the burning particles of fuel in suspension inside the fire chamber 12 for an extended period of time. This allows for complete combustion of the fule and minimizes the loss of fuel particles and heat up the chimney. Further, the efficient combustion results in lesser ash accumulation within the fire chamber 12. The flame cradles around the extended flue 31 and creates a vortex effect which increases the turbulence of the hot combustion gases, holds the heat in the fire chamber 12 longer, burns the fuel thoroughly and efficiently, and gives off an even supply of heat over an extended period of time. To extinquish the fire, the draft caps 29 are simply closed to cut off the flow of air and the fire will extinquish in a matter of minutes.

Thus, it can be seen that a novel flue arrangement for a stove or fireplace has been provided which accomplishes at least all of its stated objectives.

Obviously, many modifications and variations of the present invention are possible in light of the above teachings. It is therefore to be understood that, within the scope of the appended claims, the invention may be practiced otherwise than as specifically described.

I claim:

1. A stove having a fire chamber, said stove consisting of:

a cooking surface defining the upper part of said fire chamber, said surface including a first flat rear surface, a second flat front surface defining a plane parallel to the plane of said first surface, and an arcuate surface interconnecting said first and second surfaces, said arcuate surface defining a ninety degree (90°) arc; and a cylindrical flue attached to said stove and spaced from the rear wall of said fire chamber extending forwardly parallel to and below said arcuate surface, said flue having a forward open end, whose opening is in a plane perpendicular to said flat surfaces, and which terminates within said fire chamber at the midpoint of the radius of said arcuate surface; wherein, the plane of the opening is parallel to the plane of rising gases in the fire chamber, and said arcuate surface directs those gases towards said first flat rear surface.

* * * * *